United States Patent [19]

Vanden Hoek

[11] 4,144,924

[45] Mar. 20, 1979

[54] PANEL CONNECTOR SYSTEM

[75] Inventor: Harold L. Vanden Hoek, Grand Rapids, Mich.

[73] Assignee: Steelcase Inc., Grand Rapids, Mich.

[21] Appl. No.: 892,101

[22] Filed: Mar. 31, 1978

[51] Int. Cl.[2] ..... E06B 9/00

[52] U.S. Cl. ..... 160/231 A; 160/135

[58] Field of Search ..... 160/135, 229 R, 231 R, 160/231 A, 232, 351; 52/582, 829, 830

[56] References Cited

U.S. PATENT DOCUMENTS

| | | | |
|---|---|---|---|
| 2,210,652 | 8/1940 | Dennett | 160/231 A |
| 2,812,023 | 11/1957 | Laity, Sr. et al. | 160/231 R |
| 3,063,105 | 11/1962 | Hollands | 160/229 R |
| 3,527,283 | 9/1970 | Butler et al. | 160/231 A |
| 3,592,289 | 7/1971 | Aysta | 160/135 |
| 3,788,378 | 1/1974 | Sobel | 160/135 |
| 3,871,435 | 3/1975 | Lopatka | 160/135 |
| 3,895,670 | 7/1975 | Bales et al. | 160/135 |
| 3,987,838 | 10/1976 | LaGue et al. | 160/135 |

*Primary Examiner*—Peter M. Caun

*Attorney, Agent, or Firm*—Price, Heneveld, Huizenga & Cooper

[57] ABSTRACT

The specification discloses a panel system in which panels are joined by one (at an angle) or two (in a straight line) elongated, flexible hinge(s) which is secured to each of the panels to be joined by being clamped between the end of the panel and an end cover which is readily removable from the panel. The end cover and the end of the panel both include flanges which interengage. The flanges on the end of the panel are relatively short so that by sliding the end cover only a short distance vertically, one can either secure it in position or remove it. The end cover includes a top shoulder and the end of the panel includes a bottom shoulder between which the elongated flexible hinge member extends with its top edge generally adjacent or abutting the top shoulder and its bottom edge generally adjacent or abutting the bottom shoulder, such that two adjacent panels joined by the hinge are automatically properly aligned.

38 Claims, 9 Drawing Figures

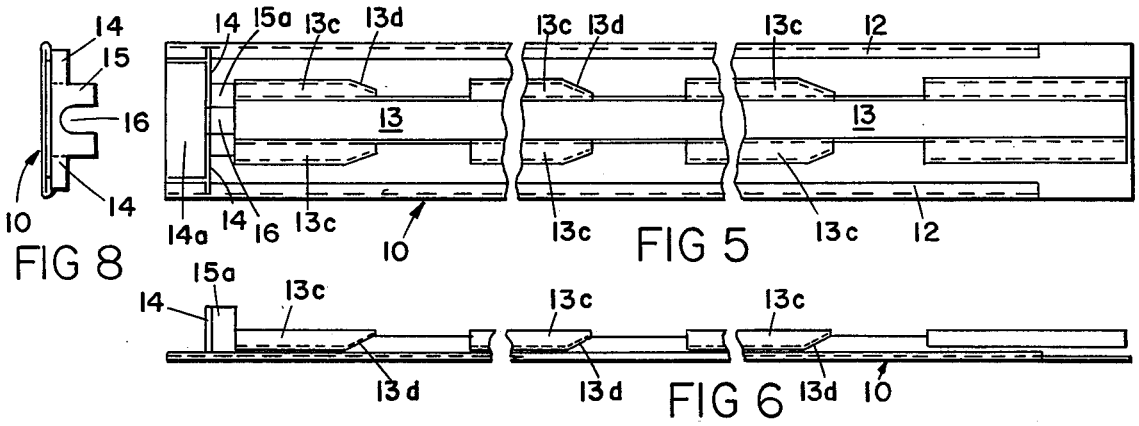
FIG 8
FIG 5
FIG 6
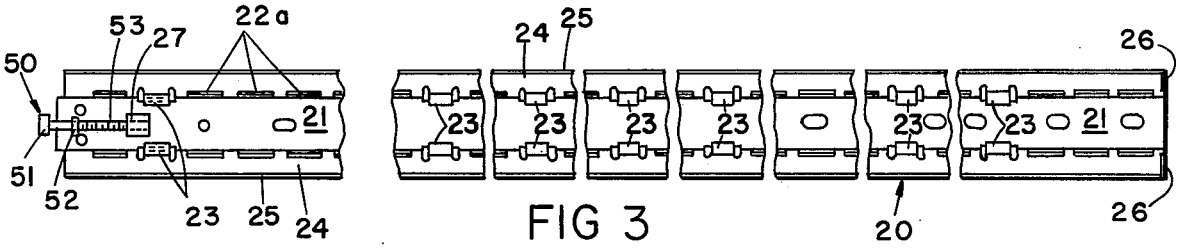
FIG 3
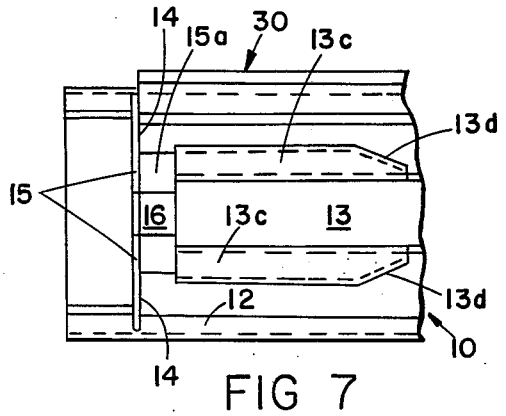
FIG 7
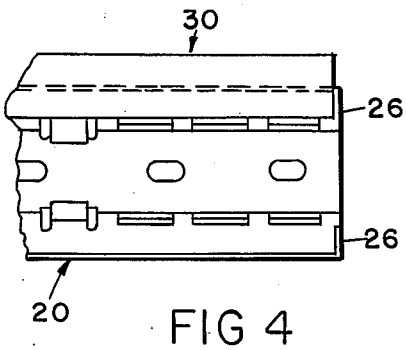
FIG 4
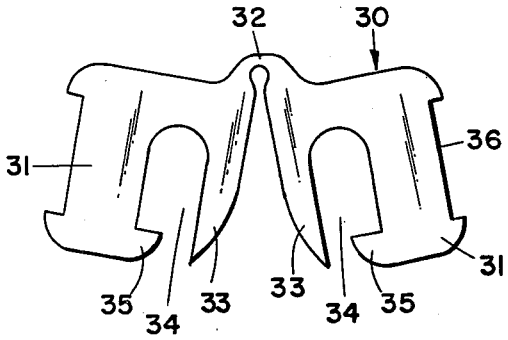
FIG 9

PANEL CONNECTOR SYSTEM

BACKGROUND OF THE INVENTION

The present invention relates to panel systems in which adjacent panels are joined by an elongated flexible hinge. Such a hinge extends generally the height of the panels to be joined and includes some sort of elongated flexible midsection such that that portion of the hinge on one side of the midsection can be joined to one panel, that portion on the other to the other panel and the two panels can then be angularly adjusted relative to one another because of the flexible midsection.

Such longitudinal flexibility is what is referred to by the term "flexible" as it is used herein. Such hinges may also have flexibility laterally, as for example, where they are extruded out of a flexible plastic material. In such systems, the flexible hinge is joined to the two panels by sliding it endwise into some sort of receiving channel at the end of the panel. The hinge must be fed down the entire height of the panel.

The problem with such a system is that it is cumbersome to slide the flexible hinge in and out of its respective channels. Everything has to be carefully aligned both at the beginning and during the entire sliding operation. Thus, the ability of the user to readily rearrange his panels as necessary is seriously hindered. Further, installation costs are driven up.

One prior art panel art system avoids the sliding problem by clamping the flexible connector behind a plate which in turn is screwed by multiple screws to the end of the panel. However, such arrangement is permanent in nature in that one is reluctant to start removing a plurality of screws from a structure just to facilitate moving it around. Further, the system would require a good deal of installation time and it would be difficult to properly hold the flexible hinge in place while the clamping plate is being applied.

Another problem encountered when an elongated flexible hinge is used is that of aligning the panels vertically, i.e., making sure that the top edges and the bottom edges are aligned. Where a conventional strap hinge is used, across the top and bottom of the adjoining panels, alignment is automatic. However, where an elongated flexible hinge is employed, it can tend to slide up or down causing misalignment of the panels at their tops and bottoms.

SUMMARY OF THE INVENTION

In the present invention, the elongated hinge is joined to each of two adjacent panels in a panel system by being clamped between a removable cover and the end edge of the panel, with mobility and ease of installation being achieved by using an interengaging flange system to join the removable end cover to the end of the panel. The end cover includes at least two separate first flange means on an inside surface thereof which slides behind second flange means on the end edge of the panel such that the end cover can readily be removed or installed by sliding it vertically. At least one of the sets of flanges is relatively short as compared to the overall height of the panel whereby the extent of such vertical movement required is relatively slight.

In another aspect of the invention, vertical alignment of the two panels is facilitated because that portion of the hinge which is clamped between the end cover and the end of the panel extends between top and bottom shoulders on one or the other or a combination of both of the removable end cover and the end of the panel. Because the top of the flexible hinge is located near or abutting the top shoulder and the bottom of the flexible hinge is located near or abutting the bottom shoulder, the adjacent panels are automatically aligned.

These and other aspects, objects, advantages and features of the invention will be more fully understood and appreciated by reference to the written specification and appended drawings.

BRIEF DESCRIPTION OF THE DRAWINGS

FIG. 3 is a broken, elevational view of the exposed end of the panel, shown laying horizontally for convenience purposes;

FIG. 4 is an enlarged, fragmentary view of the bottom end of the end of the panel with the end cover removed and with a flexible hinge in position;

FIG. 5 is a broken elevational view of the inside face of the end cover, shown lying horizontally for convenience;

FIG. 6 is a side elevational view of the end cover;

FIG. 7 is a fragmentary elevational view of the inside surface of the top portion of the inside surface of the end cover with a hinge in place;

FIG. 8 is a top plan view of the upper end of the end cover; and

FIG. 9 is a top plan view of the elongated flexible hinge.

DESCRIPTION OF THE PREFERRED EMBODIMENT

Figure 1:
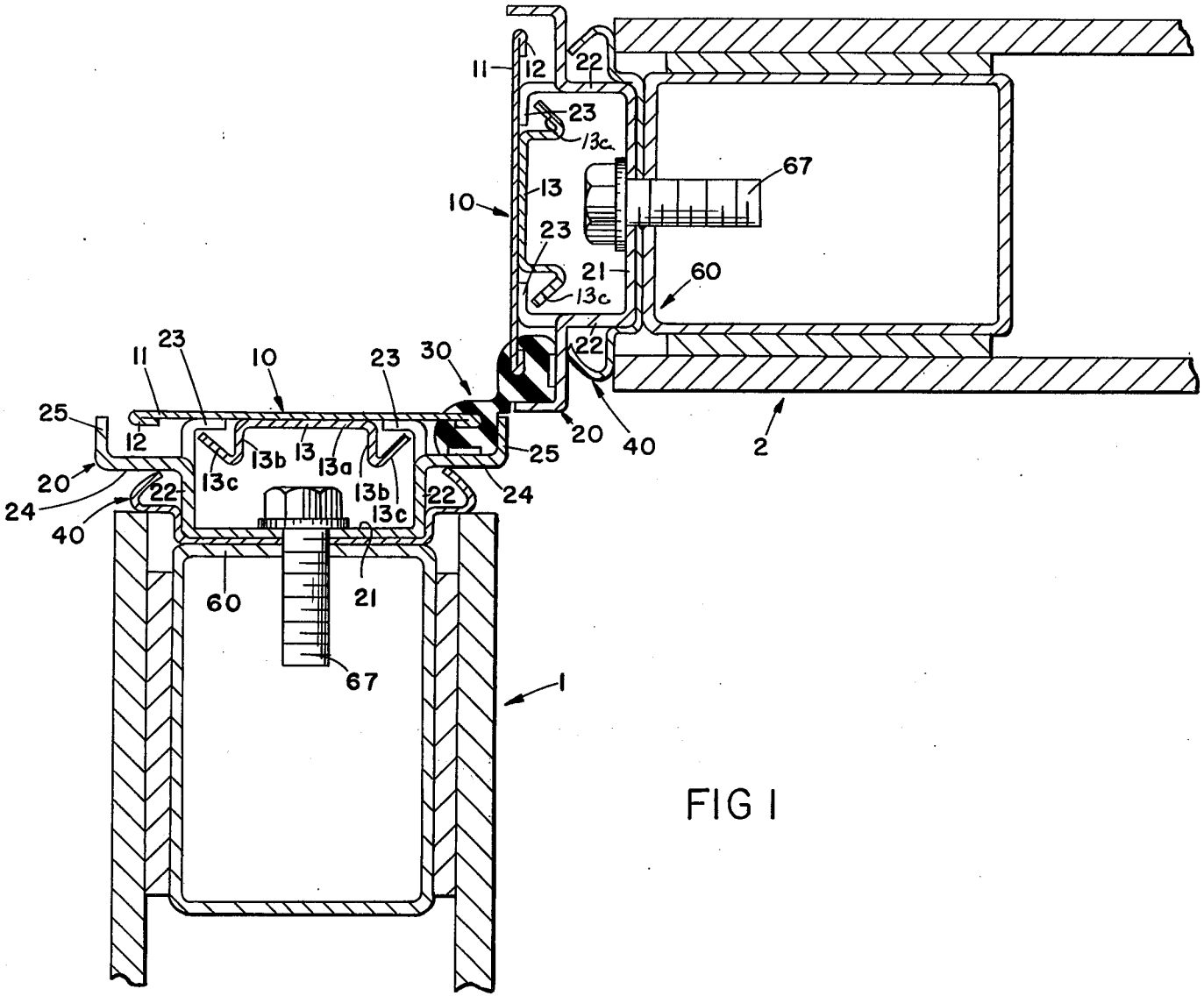
FIG. 1 is a lateral, cross-sectional view of the end portions of two end panels hinged together in accordance with the present invention.

In the preferred embodiment, the flexible hinge 30 is joined to the adjacent panels 1 and 2 by being clamped between an end piece 20 on each panel and an end cover 10 (FIG. 1). The projecting flanges 13c on a flange plate 13 on end cover 10 slide behind the receiving flanges 23 on end piece 20 to properly secure cover 10 to end piece 20. Vertical alignment of the adjacent panels is insured because the ends of hinge 30 abut or are positioned relatively close to bottom shoulders 26 on end piece 20 (FIGS. 3 and 4) and top shoulder 14 on end cover 10 (FIGS. 5 and 7).

Figure 2:
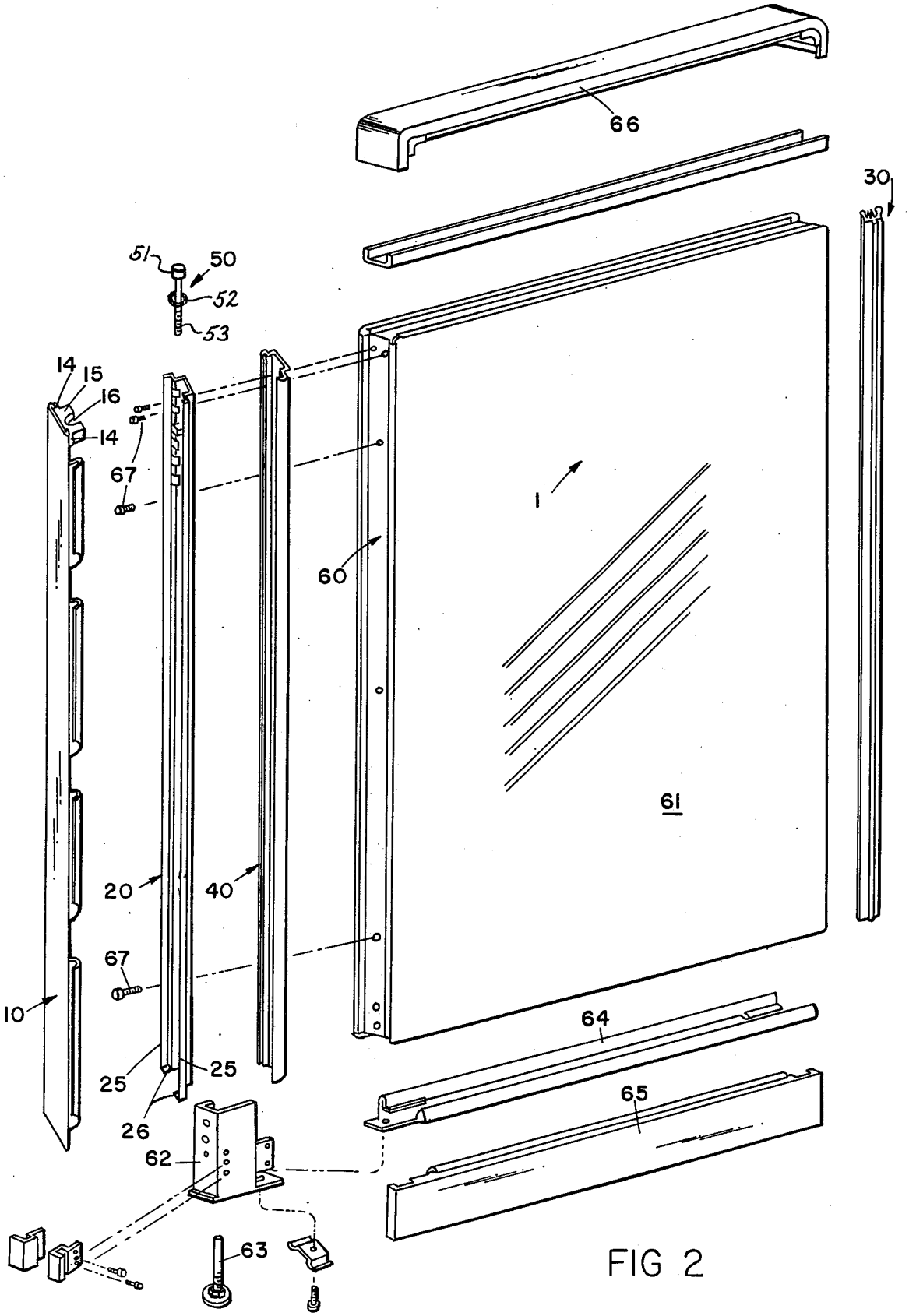
FIG. 2 is an exploded perspective view of a panel made in accordance with the present invention.

Each of the panels 1 and 2 comprises a generally rectangular frame 60 to which are joined generally planar panel coverings 61 (FIG. 2). End piece 20 is secured to frame 60 by numerous attaching bolts 67, a few of which are shown in FIG. 2. Clamped between end piece 20 and frame 60 is a plastic extrusion comprising a slot cover extrusion 40. The flaps on slot cover extrusion 40 cover the slots in end piece 20 into which brackets for hanging work surfaces or cabinets on the panels can be inserted. End cover 10 can then be attached to end piece 20 utilizing bolt 50. There is a foot 62 at the bottom and each end of panel 1 (only one being shown in FIG. 2), a leveler 63 which is threaded into foot 62, a wiring way 64 extending between feet 62, and a wiring way cover 65. Each panel also includes a top trim assembly 66.

End cover 10 comprises an exterior metal plate 11 which forms the decorative exterior surface thereof (FIG. 1). Exterior plate 11 is bent over along each lateral edge to define an inwardly projecting lip 12 which helps to secure hinge 30 to the edge of exterior plate 11.

Flange plate 13 is welded to the inside face of exterior plate 11. Flange plate 13 includes a base wall 13*a* which lies directly against the inside surface of exterior plate 11. Projecting away from base wall 13*a* is leg wall 13*b*. The metal is then bent rearwardly again and a return wall or flange 13*c* extends back towards, but stops short of, the interior surface of exterior plate 11. As can be seen by reference to FIGS. 5–7, each flange 13*c* includes an inclined leading edge 13*d* which serves as an inclined ramp and facilitates the sliding action of flanges 13*c* as they slide behind flanges 23 on end piece 20. As can also be seen by reference to FIGS. 5–6, flanges 13*c* are interrupted along the length of flange plate 13 so that each flange 13*c* is relatively short compared to the overall length of end cover 10.

Located near the top of end cover 10 is a top shoulder 14 (FIGS. 5–8). Top shoulder 14 is formed by a generally L-shaped plate whose base wall 14*a* is welded to the exterior plate 11 of the end cover 10 (FIG. 5). At each side, shoulder 14 serves as a shoulder against which the top edge of a hinge 30 bears to insure proper alignment of adjacent panels (FIG. 7). However, the central portion of flange 14 serves as a bolt shoulder 15 with a notch 16 therein which receives bolt 50. The bolt then bears against the top or bottom of bolt shoulder 15 to facilitate raising or lowering of end cover 10 relative to end piece 20. To give added strength to the bolt shoulder area 15, a bolt shoulder reinforcement block 15*a* is welded beneath bolt shoulder 15.

End piece 20 on either panel 1 or 2 is formed of bent sheet steel. It includes a base wall 21 which fits against frame 60 with slot cover extrusion 40 sandwiched therebetween (FIG. 1). Extending outwardly from base wall 21 are sidewalls 22 and it is in sidewalls 22 that slots 22*a* are formed to facilitate mounting hanger brackets therein.

Extending laterally from sidewalls 22 and out towards either side of the panel are channel base walls 24 which define the base of a channel which receives a portion of hinge 30. The sheet metal is then bent again so that a channel sidewalls 25 extends outwardly from channel base wall 24 in the direction of the terminal end of panel assembly 1. Flanges 23 are stamped out of channel base wall 24 and extend first towards cover 10 and then turn in towards one another so that flanges 13*c* slide in behind them. As can be seen by reference to FIG. 3, flanges 23 are very short relative to the overall length of end piece 20 so that the extent of vertical movement of end cover 10 which is needed to positively secure it in position on end piece 20 is relatively short.

The slots 22*a* in sidewalls 20 also extend slightly around the corner into channel base wall 24 and are therefore also visible in FIG. 3.

The channel sidewalls 25 are bent over at the bottom to define inwardly projecting bottom shoulders 26 (FIGS. 1, 3 and 4). When a hinge 30 is in place within the channel defined by channel base wall 24, channel sidewall 25, and a portion of flange 23, its bottom edge abuts against one or the other of the bottom shoulders 26 (FIG. 4).

Welded to base wall 21 near the top thereof is a threaded nut 27 and receiving bolt 50 (FIG. 3). The threaded shank of bolt 50 is threaded into nut 27 to facilitate securance or removal of end cover 10 relative to end piece 20.

Flexible hinge 30 is extruded of a plastic material such as polypropylene (FIGS. 1 and 9). It includes mounting portions 31 joined to either side of a flexible juncture portion 32. Each mounting portion 31 has the general overall configuration of the channel defined by channel base wall 24 and channel sidewall 25 so that it readily fits within that hinge receiving channel (FIG. 1). It is not necessary that each mounting portion 31 has the same width as the width of the hinge receiving channel between channel sidewall 25 and the back of flange 23.

A flap 33 extends generally from juncture portion 32 outwardly approximately the same distance as mounting portion 31, but at a point spaced from mounting portion 31 so as to define a recess or groove 34 between flap 33 and mounting portion 31 (FIG. 9). Groove 34 slips over the lateral edge of the exterior plate 11 of cover 10 as shown in FIG. 1. Mounting portion 31 includes a mating lip 35 which projects towards flap 33 to somewhat close off the opening to recess 34. When hinge 30 is slipped over the lateral edge of cover 10, mating lip 35 snaps in behind inwardly protruding lip 12 on exterior plate 11 of end cover 10 to lock hinge 30 in place on end cover 10.

Each mounting portion 31 also includes a rear groove 36 in the back wall thereof. The primary purpose of rear groove 36 is to facilitate extrusion, but it may also facilitate the compressibility of mounting portion 31 and help secure a tight, compressed fit, when mounting portion 31 is clamped between end cover 10 and end piece 20.

Bolt 50 includes a threaded shank 53, a head 51, and a radial flange or apron 52 which is spaced from head 51 and is located generally at the upper end of threaded shank portion 53 (FIGS. 2 and 3). The distance between apron 52 and head 51 is approximately the height of bolt shoulder 15 and its reinforcement 15*a*. When head 51 is located on the top of bolt shoulder 15 and apron 52 is located on the bottom thereof, below reinforcement 15*a*, one can readily raise or lower end cover 10 relative to end piece 20 by threading bolt 50 inwardly or outwardly in nut 27.

In operation, the user first snaps hinge 30 over a lateral edge of end cover 10 on one of the two panels 1 and 2, while end cover 10 is still separated from its respective panel. Hinge 30 does not have to be slid onto end cover 10, but can simply be snapped over it. The position of hinge 30 along the lateral edge of cover 10 is adjusted until its top edge comes to rest against top shoulder 14.

End cover 10 is then placed against the end of its respective panel such that bolt 50 is located within notch 16, and the head of bolt 50 is positioned above bolt shoulder 15 and apron 52 is located below bolt shoulder 15. The distance between head 51 and apron 52 is sufficiently great that end cover 10 can be moved up and down slightly. In this way, ramp portions 13*d* of flanges 13*c* can be started into position behind flanges 23 on end piece 20. Both flanges 23 and flanges 13*c* are open at their ends and along their side edges so that they can slide in behind one another.

With the securing operation thus started, one uses an Allen wrench or the like to rotate bolt 50 so as to thread it into nut 27. As bolt 50 rotates downwardly into nut 27, end cover 10 is moved downwardly and flanges 23 slide up ramps 13*d* into position behind the main body of flanges 13*c*. Eventually, the bottom edge of hinge 30 comes to rest against bottom shoulders 26 on end piece 20. End cover 10 is now tightly in place on one of the two panels.

The operation is then repeated on the other side of hinge 30 and with another end cover 10 and its respective panel. Once this is completed, two panels are joined together in a hinged fashion and are properly vertically aligned.

A hinge 30 can be located at either corner of end piece 20. Indeed, when one is aligning the panels in a straight line, one can use two elongated hinges 30 for joining two panels, one at each corner of the two panels.

Of course, it is understood that the above is merely a preferred embodiment of the invention and that various changes and alterations can be made without departing from the spirit or broader aspects thereof as set forth in the appended claims.

The embodiments of the invention in which an exclusive property or privilege is claimed as defined as follows.

1. In a panel system in which at least two panels are joined together, with their end edges generally adjacent, by at least one elongated, longitudinally flexible hinge, the improvement comprising:

a removable end cover covering the end edge of each of said panels, said end cover including an inside surface facing said end edge of said panel;

at least two separate first flange means on said inside surface of said end cover, each having at least one end and at least one side edge, one said flange means being located towards the top thereof and one located towards the bottom thereof, each being set off from said inside surface to define a space between each said first flange means and said inside surface, said space being open at least at said end of said flange means and at least along said side edge of said flange means;

second flange means on said end edge of each said panel, one located towards the top thereof and the other located towards the bottom thereof at a distance corresponding to the distance between said first flange means on said end cover, each said second flange means having at least one end and at least one side edge, and each said second flange means being set off from said end edge to define a space between each said second flange means and said end edge, said space being open at least at said end of said flange means and along at least said side edge thereof:

said first flange means being slidably received behind said second flange means whereby said end cover can be secured to or removed from said end edge of its respective panel by sliding said end cover either in one vertical direction or the other, at least one of said first and second flange means being relatively short as compared to the overall height of said panel whereby the extent of said vertical movement required is relatively slight;

said end cover and said end edge of said panel including cooperating hinge receiving means which open in the vicinity of at least one vertical corner of said end edge; said flexible hinge including a first portion positioned within said cooperating hinge receiving means on one of said panels, and thereby being clamped between said end cover and said end of said panel, said hinge including a second portion clamped within said hinge receiving means of the other of said panels, between its end cover and its end edge.

2. The panel system of claim 1 in which with respect to each of said panels and its end cover, there is a nut means secured to one of said end edges and said cover member and a bolt receiving shoulder secured to the other of said end edges and said cover;

a bolt extending through said bolt receiving shoulder having a head positioned on one side of said shoulder and a radially projecting apron spaced from said head and located at the other side of said shoulder, said bolt being threadably engaged with said nut whereby by tightening or loosening said bolt, one effects vertical movement of said cover relative to said end edge of said panel and thereby tightly secures or removes said cover from

3. The panel system of claim 2 in which there are a plurality of separate first and second flange means located at a plurality of points along the length of said covers and said end edges of said panels.

4. The panel system of claim 3 in which there is a channel at said end edge of each said panel which opens outwardly away from said end edge of said panel;

said hinge first and second portions which are received within said cooperating hinge receiving means being shaped generally in accordance with the interior shape of said channel whereby each said portion is received within its respective one of said channels;

said end cover being sufficiently wide to cover only a portion of said channel to thereby trap said hinge portion within said channel whereby said cover and said channel define said cooperating hinge receiving means.

5. The panel system of claim 4 in which said hinge includes a flap spaced from that portion of said hinge which is received within said cooperating hinge receiving means, whereby a recess is defined between said flap and said portion;

said recess fitting over and being seated on the vertical side edge of said end cover.

6. The panel system of claim 5 in which said vertical side edge of said end cover is shaped to define an inwardly facing lip which faces towards said end of said panel; said hinge including a mating lip which projects towards but is spaced slightly from said flap and which snaps over and matingly engages said lip on said end cover to lock said hinge to said end cover.

7. The panel system of claim 6 in which said hinge is made entirely of a flexible plastic material.

8. The panel system of claim 7 in which at least one of each said first and second flange means includes an inclined ramp extending from said open end thereof whereby as said first and second flange means slide into engagement, said end cover is moved more tightly against said end of said panel.

9. The panel system of claim 8 in which there are top shoulder means on one of said end cover and said end edge of said panel located generally towards the top of said end edge of said panel; bottom shoulder means on one of said cover and said end edge located generally towards the bottom of said end edge of said panel; said flexible hinge extending generally the height of said panel and being approximately as long as the distance between said top and bottom shoulders, said flexible hinge including a top edge and a bottom edge; said top edge of said flexible hinge being located near or abutting said top shoulder and said bottom edge being located near or abutting said bottom shoulder when said flexible hinge is clamped in position between said end cover and said end edge of said panel whereby said adjacent panels are aligned vertically relative to one another when said flexible hinge is clamped in position in each of said adjacent panels.

10. The panel system of claim 9 in which said end edge of said panel comprises: a metal member having a back wall joined to said panel, spaced sidewalls extending from said back wall towards said end cover, channel base walls extending laterally outwardly from said sidewalls towards the planes defined by the exterior sides of said panels, and channel sidewalls extending from said channel base walls towards the extreme end of said panel; said second flange means being defined by tabs stamped out of said channel base wall and extending generally straight from said sidewalls of said metal member and being bent over inwardly towards one another and away from said channel side walls.

11. The panel system of claim 10 in which said cover includes a first metal plate and a second metal plate welded to said first plate and having portions bent up away from said first plate and then back towards said first plate, but terminating short thereof to define said first flange means.

12. The panel system of claim 11 in which one of said top and bottom shoulder is located on said end cover and the other is located on said end edge of said panel whereby said hinge can be first properly positioned on said end cover and will subsequently serve to properly position said end cover on said end edge of said panel.

13. The panel system of claim 12 in which said top shoulder is located on said end cover adjacent said bolt receiving shoulder.

14. The panel system of claim 9 in which one of said top and bottom shoulder is located on said end cover and the other is located on said end edge of said panel whereby said hinge can be first properly positioned on said end cover and will subsequently serve to properly position said end cover on said end edge of said panel.

15. The panel system of claim 14 in which said top shoulder is located on said end cover adjacent said bolt receiving shoulder.

16. The panel system of claim 4 in which said end edge of said panel comprises: a metal member having a back wall joined to said panel, spaced sidewalls extending from said back wall towards said end cover, channel base walls extending laterally outwardly from said sidewalls towards the planes defined by the exterior sides of said panels, and channel sidewalls extending from said channel base walls towards the extreme end of said panel; said second flange means being defined by tabs stamped out of said channel base wall and extending generally straight from said sidewalls of said metal member and being bent over inwardly towards one another and away from said channel side walls.

17. The panel system of claim 16 in which said cover includes a first metal plate and a second metal plate welded to said first plate and having portions bent up away from said first plate and then back towards said first plate, but terminating short thereof to define said first flange means.

18. The panel system of claim 1 in which there are top shoulder means on one of said end cover and said end edge of said panel located generally towards the top of said end edge of said panel; bottom shoulder means on one of said cover and said end edge located generally towards the bottom of said end edge of said panel; said flexible hinge extending generally the height of said panel and being approximately as long as the distance between said top and bottom shoulders, said flexible hinge including a top edge and a bottom edge; said top edge of said flexible hinge being located near or abutting said top shoulder and said bottom edge being located near or abutting said bottom shoulder when said flexible hinge is clamped in position between said end cover and said end edge of said panel whereby said adjacent panels are aligned vertically relative to one another when said flexible hinge is clamped in position in each of said adjacent panels.

19. The panel system of claim 1 in which at least one of each said first and second flange means includes an inclined ramp extending from said open end thereof whereby as said first and second flange means slide into engagement, said end cover is moved more tightly against said end of said panel.

20. The panel system of claim 19 in which one of said top and bottom shoulder is located on said end cover and the other is located on said end edge of said panel whereby said hinge can be first properly positioned on said end cover and will subsequently serve to properly position said end cover on said end edge of said panel.

21. The panel system of claim 20 in which said top shoulder is located on said end cover adjacent said bolt receiving shoulder.

22. The panel system of claim 1 in which said hinge is made entirely of a flexible plastic material.

23. The panel system of claim 22 in which said hinge includes a flap spaced from that portion of said hinge which is received within said cooperating hinge receiving means, whereby a recess is defined between said flap and said portion;

said recess fitting over and being seated on the vertical side edge of said end cover.

24. The panel system of claim 23 in which said vertical side edge of said end cover is shaped to define an inwardly facing lip which faces towards said end of said panel; said hinge including a mating lip which projects towards but is spaced slightly from said flap and which snaps over and matingly engages said lip on said end cover to lock said hinge to said end cover.

25. The panel system of claim 1 in which there is a channel at said end edge of each said panel which opens outwardly away from said end edge of said panel;

said hinge first and second portions which are received within said cooperating hinge receiving means being shaped generally in accordance with the interior shape of said channel whereby each said portion is received within its respective one of said channels;

said end cover being sufficiently wide to cover only a portion of said channel to thereby trap said hinge portion within said channel whereby said cover and said channel define said cooperating hinge receiving means.

26. The panel system of claim 25 in which said end edge of said panel comprises: a metal member having a back wall joined to said panel, spaced sidewalls extending from said back wall towards said end cover, channel base walls extending laterally outwardly from said sidewalls towards the planes defined by the exterior sides of said panels, and channel sidewalls extending from said channel base walls towards the extreme end of said panel; said second flange means being defined by tabs stamped out of said channel base wall and extending generally straight from said sidewalls of said metal member and being bent over inwardly towards one another and away from said channel side walls.

27. The panel system of claim 26 in which said cover includes a first metal plate and a second metal plate welded to said first plate and having portions bent up away from said first plate and then back towards said first plate, but terminating short thereof to define said first flange means.

28. The panel system of claim 3 in which at least one of each said first and second flange means includes an inclined ramp extending from said open end thereof whereby as said first and second flange means slide into engagement, said end cover is moved more tightly against said end of said panel.

29. In a panel system in which at least two panels are joined together with their end edges generally adjacent by at least one flexible hinge, the improvement comprising:

a removable end cover covering the end edge of each of said panels;

releasable securing means securing said end cover to said end edge of said panel but facilitating removal thereof;

top shoulder means on one of said end cover and said end edge of said panel located generally towards the top of said edge of said panel;

bottom shoulder means on one of said cover and said end edge located generally towards the bottom of said end edge of said panel;

said flexible hinge extending generally the height of said panel and being approximately as long as the distance between said top and bottom shoulders, said flexible hinge including a top edge and a bottom edge;

said flexible hinge including a portion clamped between said end cover and said end edge of each said panel with said top edge near or abutting said top shoulder and said bottom edge near or abutting said bottom shoulder whereby said adjacent panels are aligned vertically relative to one another when said flexible hinge is clamped in position in each of said adjacent panels.

30. The panel system of claim 29 in which there is a channel at said end edge of each said panel which opens outwardly away from said end edge of said panel; said hinge including a first portion received within and being shaped generally in accordance with the interior shape of said channel in one of said panels and a second portion received within and shaped generally in accordance with the interior shape of said channel on said second panel; said end cover being sufficiently wide to cover only a portion of said channel to thereby trap said hinge portion within said channel whereby said cover and said channel define cooperating hinge receiving means.

31. The panel system of claim 30 in which said hinge includes a flap spaced from that portion of said hinge which is received within said cooperating hinge receiving means, whereby a recess is defined between said flap and said portion;

said recess fitting over and being seated on the vertical side edge of said end cover.

32. The panel system of claim 31 in which said vertical side edge of said end cover is shaped to define an inwardly facing lip which faces towards said end of said panel; said hinge including a mating lip which projects towards but is spaced slightly from said flap and which snaps over and matingly engages said lip on said end cover to lock said hinge to said end cover.

33. The panel system of claim 32 in which said hinge is made entirely of a flexible plastic material.

34. The panel system of claim 33 in which one of said top and bottom shoulder is located on said end cover and the other is located on said end edge of said panel whereby said hinge can be first properly positioned on said end cover and will subsequently serve to properly position said end cover on said end edge of said panel.

35. The panel system of claim 34 in which said top shoulder is located on said end cover.

36. The panel system of claim 29 in which said hinge is made entirely of a flexible plastic material.

37. The panel system of claim 29 in which one of said top and bottom shoulder is located on said end cover and the other is located on said end edge of said panel whereby said hinge can be first properly positioned on said end cover and will subsequently serve to properly position said end cover on said end edge of said panel.

38. The panel system of claim 37 in which said top shoulder is located on said end cover.

* * * * *

UNITED STATES PATENT AND TRADEMARK OFFICE

CERTIFICATE OF CORRECTION

PATENT NO. : 4,144,924

DATED : 03/20/79

INVENTOR(S) : Harold L. VandenHoek

It is certified that error appears in the above-identified patent and that said Letters Patent are hereby corrected as shown below:

Column 3, line 41:

"sidewalls" should be --sidewall--

Column 6, line 11:

insert --said end edge--

Column 9, line 22:

before "edge" insert --end--

Signed and Sealed this

*Seventeenth* Day of *July 1979*

[SEAL]

*Attest:*

*Attesting Officer*

LUTRELLE F. PARKER

*Acting Commissioner of Patents and Trademarks*